United States Patent [19]

Baslow

[11] 4,197,686

[45] Apr. 15, 1980

[54] FABRIC WALL COVERING SYSTEM

[76] Inventor: Floyd M. Baslow, 201 E. 28th St., New York, N.Y. 10016

[21] Appl. No.: 966,669

[22] Filed: Dec. 5, 1978

Related U.S. Application Data

[63] Continuation-in-part of Ser. No. 811,121, Jun. 28, 1977, Pat. No. 4,151,762.

[51] Int. Cl.[2] ..... A47H 23/00; B25B 27/00

[52] U.S. Cl. ..... 52/273; 52/288; 160/327; 160/392

[58] Field of Search ..... 160/327, 392; 52/273, 52/288

[56] References Cited

U.S. PATENT DOCUMENTS

| | | | |
|---|---|---|---|
| 3,371,702 | 3/1968 | Keegan et al. | 160/392 |
| 3,514,914 | 6/1970 | Bergquist | 52/273 |
| 3,783,931 | 1/1974 | Assael | 52/288 |
| 3,833,046 | 9/1974 | Tombu | 160/327 |
| 4,018,260 | 4/1977 | Baslow | 52/273 |
| 4,053,008 | 10/1977 | Baslow | 52/273 |
| 4,151,762 | 5/1979 | Baslow | 81/3 R |

FOREIGN PATENT DOCUMENTS

| | | | |
|---|---|---|---|
| 134429 | 9/1949 | Australia | 52/273 |

*Primary Examiner*—James L. Ridgill, Jr.
*Attorney, Agent, or Firm*—Michael Ebert

[57] ABSTRACT

An easily-installed fabric wall covering system making it possible to support a fabric sheet against a wall. The system is constituted by a frame of extruded molding pieces or tracks that are attached to the wall along the perimeter of the wall surface to be covered. Each track includes a storage channel having a generally rectangular cross-section whose base is extended beyond the rear end of the channel to define a wall mounting flange. The face of the channel has an adhesive layer thereon to hold the margin of the fabric sheet while it is being mounted, the excess tail of the sheet which extends beyond the margin being stuffed by a tool into an inclined inlet at the front end of the channel. This inlet is defined by dilatable jaws that are pried open by the tool to admit the tail into the storage channel. When the tool is withdrawn, the tail is clamped by the jaws to securely anchor the sheet on the wall.

5 Claims, 16 Drawing Figures

Fig. 1.
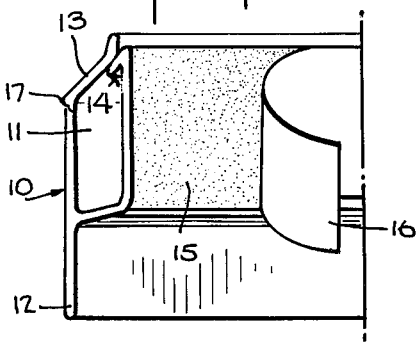
Fig. 2.
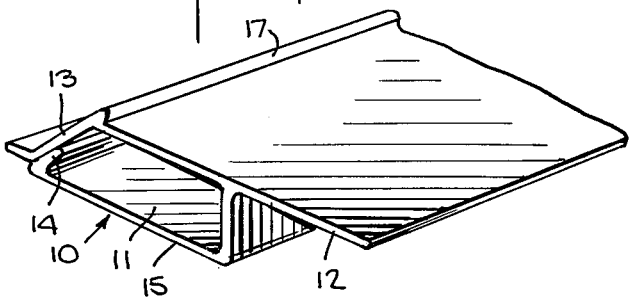
Fig. 3.
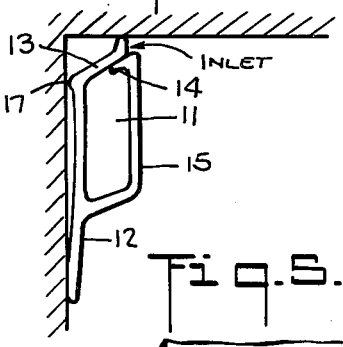
Fig. 6.
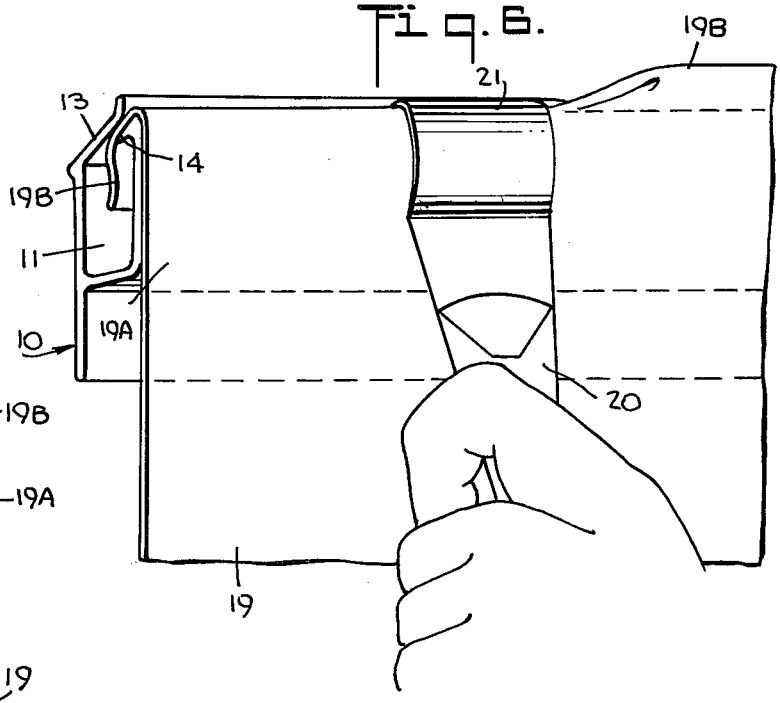
Fig. 5.
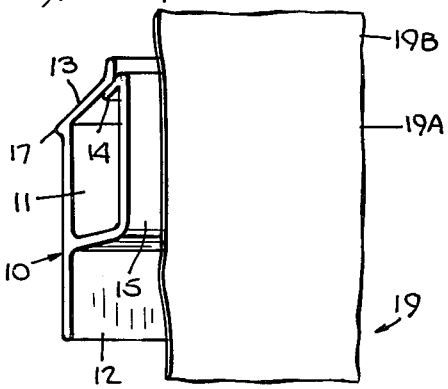
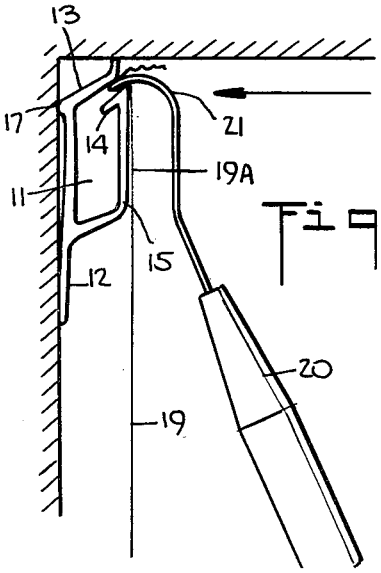
Fig. 7.
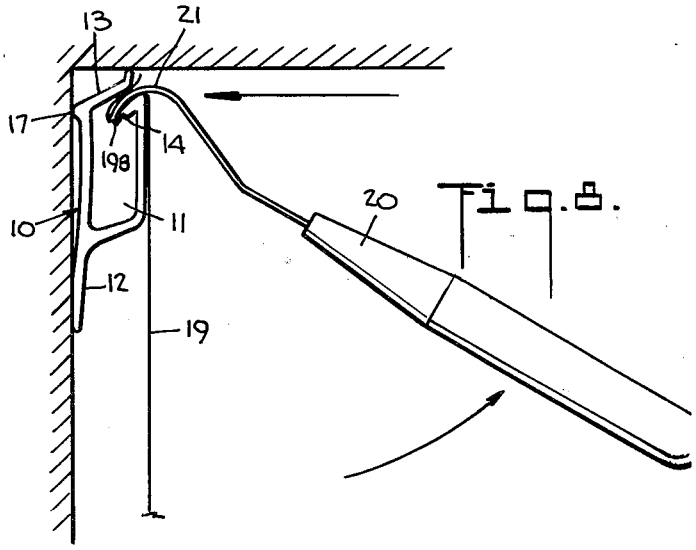
Fig. 8.

FABRIC WALL COVERING SYSTEM

RELATED APPLICATION

This application is a continuation-in-part of my copending application Ser. No. 811,121, filed June 28, 1977, now U.S. Pat. No. 4,151,762 issued May 1, 1979 the entire disclosure of which is incorporated herein by reference.

BACKGROUND OF INVENTION

This invention relates generally to extruded molding pieces or tracks which are attachable to a wall to create a frame thereon for supporting a fabric covering sheet, and more particularly to tracks which facilitate the fabric covering of outside corners in a room or for finishing off the edge of a no-return wall.

In my prior U.S. Pat. No. 4,018,260, whose entire disclosure is incorporated herein by reference, there is disclosed an easily-installed fabric wall covering system in which a frame is attached to the wall upon which one can stretch a fabric sheet to provide a smooth, attractive wall covering. This system, which uses extruded molding pieces or tracks to create the frame, makes it possible for the typical householder or do-it-yourselfer to cover the walls in any room with luxurious fabrics of his own choosing.

One may, for example, choose a wall covering fabric to match the drapery in the room, or its furniture or bedspreads, or for that mater any other distinctive element of the room decor. The system disclosed in this patent opens up a new world of decorating options, for it does away with the tedious, tricky and difficult procedures as well as the high level of professional skill heretofore required to overlay walls with fabric sheets.

The extruded molding piece or track basic to this fabric wall covering system is constituted by a storage channel having a generally rectangular cross-section. The flat front face of the channel has an adhesive layer thereon, the back or base of the channel being extended beyond its rear end to define an installation flange which is attachable by nails or other means to the wall.

The front end of the channel is provided with an inclined inlet defined by dilatable jaws of resilient material. These are normally closed but are separable by a stuffing tool. After the tracks are assembled and attached to the wall to create a frame along the perimeter of the wall surface to be covered, the margins of the sheet are pressed against the adhesive layer on the face of the tracks and the excess tails of the sheet extending beyond these margins are stuffed by a tool through the inlets into the storage channels.

When the stuffing tool is withdrawn, the inlet jaws clamp on the fabric tails and thereby serve to securely anchor the covering sheet to the wall. Because the channels can accommodate either short or long excess tails, it is not necessary to cut the fabric sheet exactly to size as in prior systems; for the installer is afforded leeway in this regard, which gives him a wide latitude of acceptable error.

Ideally, extruded molding pieces or tracks of the type disclosed in my prior patent are exactly flat, so that when applied to a planar wall, the tracks abut the wall along their entire lengths. But in practice, the pieces, when extruded of synthetic plastic, particularly in long lengths, have a tendency to bend outwardly or curl somewhat. This may create a problem in installing the tracks. Thus if the tracks are to be bonded to the wall with hot glue, unless the tracks are held pressed to the wall during the glue curing period, the tracks, because of their curl, detach themselves from the wall before the glue sets.

Another drawback encountered with existing forms of fabric-mounting tracks is when covering an outside corner or junction defined by two walls at right angles to each other. In order to establish a neat, fabric-covered junction, it is essential that the track ends on the two walls be in abutting relation and hug the corner. This is difficult to accomplish with track structures of the type disclosed in my prior patent.

Another problem experienced with existing tracks is in finishing off the edge of a no-return wall. For example, if a decorator wishes to cover one wall of a room with fabric and to leave the adjacent wall uncovered in order to create decorative contrast, then the fabric covering at the edge of this wall, using existing tracks, will leave the tracks somewhat exposed; for the fabric tail which passes around the flat face of the tracks and goes into the inlets thereof does not entirely conceal the tracks. Moreover, existing tracks present a sharp fabric edge which is not desirable at a no-return wall.

Still another drawback of existing tracks formed of opaque plastic material is that when a fabric covering is stretched over a frame created by these tracks and the covering is of sheer or open-weave construction, objectionable "see-through" or grinning effects are encountered, as a consequence of which a ghost of the frame is visible to the viewer. Ideally, the appearance of a fabric covered wall should be such that the fabric sheet extends to the very edges of the wall and presents a smooth surface with no visible means of support.

SUMMARY OF INVENTION

In view of the foregoing, the main object of this invention is to provide a fabric wall covering system constituted by extruded molding pieces or tracks which are attachable to the wall to be covered and which lie substantially flat thereagainst to facilitate attachment.

More particularly, it is also an object of the invention to provide tracks of the above type having a storage channel to which access is had through dilatable inlet jaws disposed at the front or top end of the channel, the base of the channel having a longitudinally-extending ridge or heel adjacent one of the jaws, which heel acts not only as a reinforcing rib to resist bending of the track but also as a means of hugging the apex of an outside corner to facilitate covering this corner with fabric.

Also an object of this invention is to provide tracks for a fabric wall covering system which blend with the fabric regardless of its color or pattern, whereby a fabric mounting frame formed by such tracks is not visible to an observer, even though the fabric structure has see-through characteristics.

Still another object of this invention is to provide a track having a coving-shaped inlet, making it possible to properly finish off the edge of a non-return wall, such as the junction between a fabric-covered wall and an uncovered wall at right angles thereto.

Briefly stated, in a fabric covering system in accordance with the invention, the fabric is mounted by means of a frame attached to the wall and formed by extruded molding pieces or tracks which follow the perimeter of the surface to be covered. Each track is provided with a storage channel having a generally rectangular cross-section whose base is extended beyond the rear or bottom end to define a wall mounting flange. The face of the channel has a layer of adhesive thereon whereby the margin of the fabric sheet can be held thereon to facilitate mounting procedures.

The front or top end of the channel is provided with an inlet leading to the storage channel and defined by dilatable jaws which can be pried open by a stuffing tool adapted to force the excess tail of the fabric sheet into the storage channel, the jaws, when the tool is withdrawn, clamping the tail to securely anchor the sheet. The base of the track is provided with a longitudinally-extending heel adjacent the inlet jaws to resist bending of the track, the heel also serving to hug an outside corner when the track is used to cover such a corner.

OUTLINE OF DRAWINGS

For a better understanding of the invention as well as other objects and further features thereof, reference is made to the following detailed description to be read in conjunction with the accompanying drawings, wherein:

FIG. 1 is a perspective view of a track for use in a fabric wall covering system in accordance with the invention;

FIG. 2 is a rear view of the track;

FIG. 3 is an end view showing the track attached to a wall just below the ceiling of a room;

Figure 9:
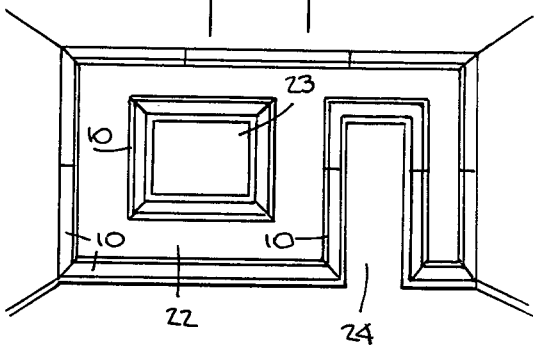
Figure 10:
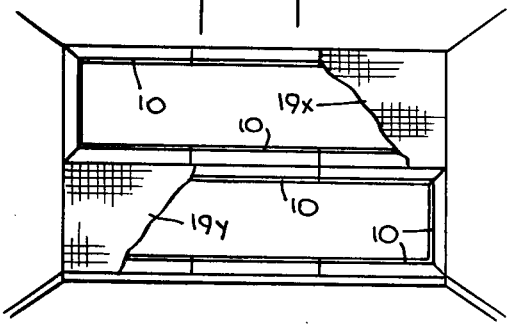
Figure 13:
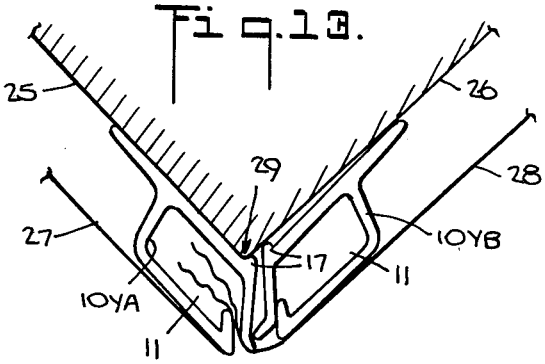
Figure 11:
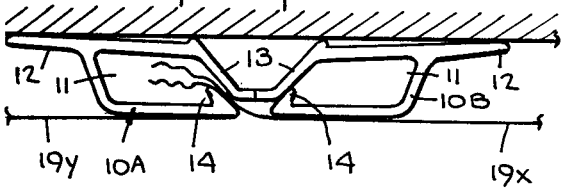
Figure 15:
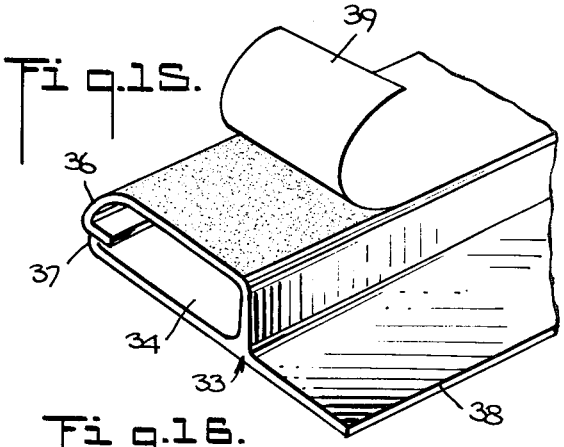
Figure 12:
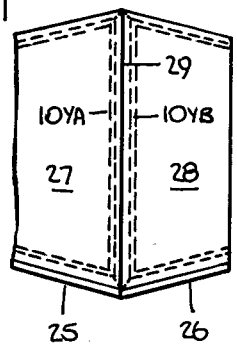
Figure 14:
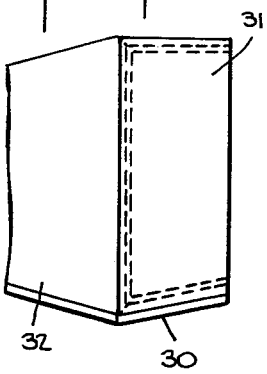
Figure 16:
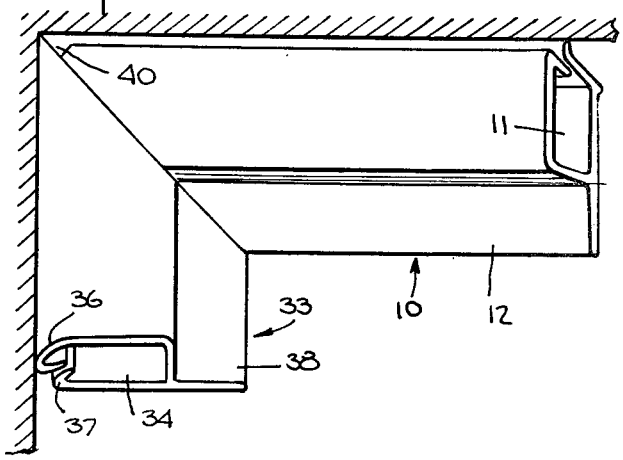

FIG. 5 reveals the manner in which the margin of the fabric sheet is placed over the track face;

FIG. 6 illustrates the tool by means of which the excess tail of the fabric sheet whose margin is adhered to the track face is stuffed into the track storage channel;

FIG. 7 shows the first step in stuffing the tail into the storage channel;

FIG. 8 shows the second step in stuffing the tail into the channel;

FIG. 9 shows a track frame installed on a wall having a door and window openings;

FIG. 10 illustrates horizontal framing on a wall for supporting separate horizontal fabric panels;

FIG. 11 illustrates the manner in which the separate horizontal fabric panels are secured to abutting tracks;

FIG. 12 illustrates an outside corner to be covered;

FIG. 13 illustrates the relationship of the tracks to the outside corner;

FIG. 14 shows a no-edge return at an outside corner defined by a covered and a non-covered wall at right angles to each other;

FIG. 15 is a perspective view of a track in accordance with the invention having a coving-shaped inlet for use in finishing off the edge of a no-return wall; and FIG. 16 shows the relationship of the coving track with a regular track at the no-return edge.

DESCRIPTION OF INVENTION

Basic Track Structure

Referring now to FIGS. 1 and 2, there is shown an extruded molding piece or track 10 in accordance with a preferred embodiment of the invention. Track 10 includes a storage channel 11 having a generally rectangular cross-section, the base of the channel extending beyond the rear or bottom end thereof to define a mounting flange 12.

The front or top end of the channel is provided with an inlet leading into the channel, the inlet being defined by resilient jaws 13 and 14 which are normally closed. The inlet jaws are at an acute angle relative to the plane of the base of the channel. Thus when the track is flush-mounted against a ceiling, as shown in FIG. 3, the inlet is inclined with respect thereto to permit entry of a stuffing tool in a manner to be later described.

The flat vertical face 15 of channel 11 has an adhesive layer thereon which is normally covered by a protective tape 16 which is stripped off only after the track is attached to a wall. Such attachment is effected in various ways as by drilling holes through flange 12 and the wall behind it to an extent permitting the insertion of plastic anchors, the flange being fastened thereto by self-tapping sheet metal screws. In the case of wood walls, the track flanges may simply be nailed thereto, or one may use two-faced adhesive foam tabs or power-driven staples to effect the necessary attachment. One can also use a hot glue gun for this purpose, the glue being preferably of the type which is quick-curing.

Track 10 further includes a longitudinally-extending ridge or heel 17 adjacent the junction of the channel base and inlet jaw 13. One advantage of this heel is that it acts as a reinforcing rib to resist bending or curling of the track. Thus the track, even in long lengths, remains substantially flat and is therefore easier to attach to the wall. Another important function of heel 17 will be later described.

Framing

Figure 4:
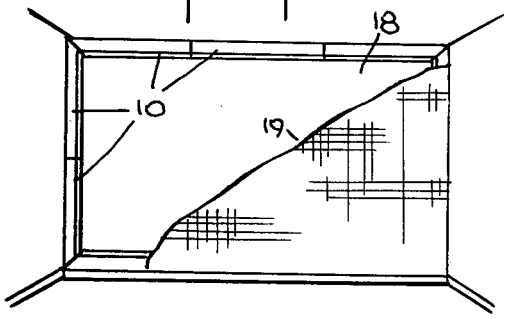
FIG. 4 illustrates a fabric-supporting frame attached to a wall to be covered, the frame being formed by tracks of the type shown in FIG. 1.

The least complicated fabric-covering installation is that shown in FIG. 4, where a wall 18 to be covered has a rectangular surface which is not interrupted by a door, a window or any other discontinuity. In this instance, one simply cuts track elements 10 to size to create a rectangular frame which follows the perimeter of the exposed wall surface. The tracks are miter-cut at the corners of the rectangle by means of a hacksaw or miter box, so that the tracks fit neatly together and there are no gaps in the frame.

Then a sheet of fabric covering material of any desired quality and pattern is produced whose dimensions are slightly larger in area than the rectangular surface of the wall to be covered. In practice, since most fabric comes in standard widths, it is usually necessary to stitch several panels of fabric together to develop the necessary expanse. The actual dimensions of the resultant fabric sheet are not critical; for excess material or tails of the fabric sheet are stuffed into the storage channels of the tracks.

In practice, once the track frame, as shown in FIG. 4, is created and installed on the wall to be covered, one strips off the tapes 16 from the adhesive layers on the faces 15 of the tracks, the margins of the fabric sheet 19 then being adhered thereto.

The relationship between the fabric margin and the track at this stage is shown in FIG. 5, where it will be seen that the marginal area 19A of the fabric border overlies the face 15 of the track and is adhered thereto, whereas the excess tail 19B of the fabric extends above the track. Should the tail be overbroad, it may be cut to shorten it. This excess tail is stuffed into storage channel 11 by means of a simple, manually-operated tool 20 having a putty knife-like blade 21 whose forepart is curved to facilitate entry thereof into the jaws 13 and 14 of the track, as shown in FIG. 7.

The tail 19B of fabric 19 is folded over the straight leading edge of the tool blade and forced thereby into the inlet of the track. As shown in FIG. 8, by swinging tool 20 upwardly using the ceiling as a pivot, this acts to pry open the inlet jaws to admit the tail of the fabric into storage channel 11. When the blade of the tool is thereafter withdrawn from the inlet, the resilient jaws clamp onto the tail to securely anchor the fabric to the track. In practice, as shown in FIG. 6, one draws the tool across the track to force the tail in the storage channel.

As noted previously, a track of opaque material tends to grin through a more or less porous fabric and become visible as a ghost behind the fabric. It has been found that by extruding the tracks of a translucent plastic material such as polyethylene, PVC or other suitable synthetic plastic having resilient properties and possessing good structural strength, the resultant track has chameleon-like characteristics in that it tends to pick up the color of the overlying fabric and therefore does not produce an objectionable ghost.

FIG. 9 shows typical track framing in a situation in which the wall 22 to be covered is interrupted by a window 23 and a door 24. In this instance, the frame formed by tracks 10 not only follows the perimeter of the wall but also that of the window and door. It is important here that the inlet jaws of the track abut the window and door frames; for then when the fabric is secured to the track, its edge is brought to the very edge of the window or door frame.

Where, as shown in FIG. 10, one wishes to set up on an interrupted wall of the type shown in FIG. 4 a wall covering formed by two horizontal panels of fabric 19X and 19Y without having to stitch the panels together, as in FIG. 4, to form a single sheet, one can create two (or more) horizontal frames by means of tracks 10, one for each fabric panel. Alternatively, these frames can be vertically arranged on the wall, in which case the panels are vertically mounted against the wall.

The manner of covering tracks 10A and 10B on the adjacent frames so that the horizontal fabric panels mounted thereon abut is shown in FIG. 11, where it will be seen that inlet jaws are placed in abutting relation, the tail of fabric panel 19X going into storage channel 11 of track 10A and the tail of fabric panel 19Y going into the same storage channel. In this way, the tail of the fabric panel 19Y acts to conceal the junction of the abutting tracks 10X and 10Y.

Outside Corners

We shall now consider the problem which arises when, as shown in FIG. 12, two adjacent walls 25 and 26 are to be covered by fabric panels 27 and 28, respectively, the walls being at right angles to each other to define an outside corner having an apex 29.

As shown in FIG. 13, wall 25 has a vertical track 10YA attached thereto whose heel 17 hugs the corner, the apex 29 being nested in the trough formed by heel 17 of track 10YA. The vertical track 10YB attached to wall 26 is placed snugly against track 10, and both the tail of fabric panel 28 covering wall 26 and the tail of fabric panel 27 are stuffed into storage channel 11 of track 10YA. In this way, the corner and the corner tracks are entirely covered and concealed by the fabric.

In practice, the margin of fabric panel 27 should be adhered to the face of track 10YA before removing the protective tape from the adhesive layer on the face of track 10YB. If one had a fabric sheet large enough to cover both walls 25 and 26, one could simply bypass the storage channels and tracks 10YA and 10YB.

Coving Tracks

We shall now consider a situation where it becomes necessary to finish off the edge of a no-return wall, this situation being illustrated in FIG. 14 where it will be seen that wall 30 is covered by a fabric sheet 31, whereas wall 32 at right angles thereto is uncovered. Hence the edge of fabric sheet 31 at the corner junction of the walls represents a no-return edge.

In order to finish off this no-return edge, fabric sheet 31 is mounted on a frame on wall 30 whose upper and lower horizontal branches are formed by regular tracks 10 of the type shown in FIG. 1, whereas the vertical branch of the frame is formed by a coving type track 33 of the type shown in FIGS. 15 and 16.

Coving track 33 has a storage channel 34 of generally rectangular cross-section, with its base 38 extended beyond the rear end of the channel to define a mounting flange. However, the inlet to this channel is formed by a concavely-shaped long jaw 36 which cooperates with a small jaw 37 formed by a bead at the end of the base of the channel, the jaws being dilatable to admit the excess tail of the fabric sheet.

The face 38 is provided with an adhesive layer protected by a peel-off tape 39. However, the adhesive layer in this instance is not confined to the flat face of the channel as in a regular track, preferably extends over the curved inlet jaw 36.

Thus in forming a no-return edge, the vertical margin of fabric sheet 31 is adhered over the face and the coving jaw, and as the tail is stuffed by a stuffing tool through the inlet of the regular track 10, the jaws of the coving track 33 inlet are pried open with a screw driver making it possible to stuff the tail into the mitered corner of the tracks.

The joint of the regular track 10 and the coving track 33 at the corner tip 40 thereof is trimmed off to allow proper mating of the different track shapes. Thus the shape of the coving track provides a finished edge where that edge is exposed.

I claim:

1. A fabric wall covering arrangement making it possible to support a sheet of fabric against a wall, said sheet having excess tails going beyond its margins, the system being constituted by a frame of tracks which are attached to the wall along the perimeter of the surface to be covered, each track comprising:

a storage channel having a generally rectangular cross-section whose flat base is extended beyond the rear end of the channel to define a wall mounting flange, said front end of the channel having an inlet which lies at an acute angle relative to the base and leads into the channel, said inlet being defined by a pair of upper and lower dilatable jaws of resilient material which can be pried open by a stuffing tool to admit the excess tail of the sheet through said inlets into the channel, the jaws clamping on said tails when the tool is withdrawn, and a heel extending longitudinally along the base of said channel adjacent said lower jaw forming a rib resisting bending of said track and serving, when the track is used to cover an outside corner, to hug said corner.

2. A arrangement as set forth in claim 1, wherein said channel has a face covered with an adhesive layer to hold the margin of said sheet.

3. A arrangement as set forth in claim 1, wherein said track is formed of translucent synthetic plastic material.

4. A arrangement as set forth in claim 1, further including means attaching said flange to said wall.

5. A system as set forth in claim 1, wherein said tool has a putty-knife blade whose forepart is curved.

* * * * *

UNITED STATES PATENT OFFICE

CERTIFICATE OF CORRECTION

Patent No. 4,197,686 Dated April 15, 1980

Inventor(s) Floyd M. Baslow

It is certified that error appears in the above-identified patent and that said Letters Patent are hereby corrected as shown below:

Claim 1 - line 4 "system" should have read -- arrangement --

Claim 5, line 1 "system" should have read -- arrangement --

Signed and Sealed this

Ninth Day of December 1980

[SEAL]

*Attest:*

SIDNEY A. DIAMOND

*Attesting Officer* *Commissioner of Patents and Trademarks*